US008247784B2

(12) United States Patent
Neidholdt et al.

(10) Patent No.: US 8,247,784 B2
(45) Date of Patent: Aug. 21, 2012

(54) SWITCHED FERROELECTRIC PLASMA IONIZER

(75) Inventors: Evan L. Neidholdt, Pasadena, CA (US); Jesse L. Beauchamp, La Canada Flintridge, CA (US)

(73) Assignee: California Institute of Technology, Pasadena, CA (US)

( * ) Notice: Subject to any disclaimer, the term of this patent is extended or adjusted under 35 U.S.C. 154(b) by 192 days.

(21) Appl. No.: 12/845,785

(22) Filed: Jul. 29, 2010

(65) Prior Publication Data

US 2011/0024617 A1 Feb. 3, 2011

Related U.S. Application Data

(60) Provisional application No. 61/229,700, filed on Jul. 29, 2009.

(51) Int. Cl.
*H01J 49/10* (2006.01)
*H01J 49/26* (2006.01)
*H01J 27/02* (2006.01)

(52) U.S. Cl. ..... 250/423 R; 250/424; 250/288; 250/281; 250/282; 315/111.81; 315/111.21; 315/111.01

(58) Field of Classification Search ..... 250/423 R, 250/424, 288, 281, 282; 315/111.81, 111.21, 315/111.01
See application file for complete search history.

(56) References Cited

U.S. PATENT DOCUMENTS 7,399,958 B2 * 7/2008 Miller et al. ..... 250/286
7,791,019 B2 * 9/2010 Beauchamp et al. ..... 250/288
7,821,762 B2 * 10/2010 Yasuoka et al. ..... 361/212

* cited by examiner

*Primary Examiner* — Nikita Wells
(74) *Attorney, Agent, or Firm* — Milstein Zhang & Wu LLC; Joseph B. Milstein

(57) ABSTRACT

A novel ion source for ambient mass spectrometry (switched ferroelectric plasma ionizer or "SwiFerr"), which utilizes the ambient pressure plasma resulting from a sample of barium titanate [001] whose polarization is switched by an audio frequency electric field. High yields of both anions and cations are produced by the source and detected using an ion trap mass spectrometer. Protonated amines and deprotonated volatile acid species, respectively, are detected in the observed mass spectra. Aerodynamic sampling is employed to analyze powders of drug tablets of loperamide and ibuprofen. A peak corresponding to the active pharmaceutical ingredient for each drug is observed in the mass spectra. Pyridine is detected at concentrations in the low part-per-million range in air. The low power consumption of the source is consistent with incorporation into field portable instrumentation for detection of hazardous materials and trace substances in a variety of different applications.

23 Claims, 15 Drawing Sheets

FIG. 1A
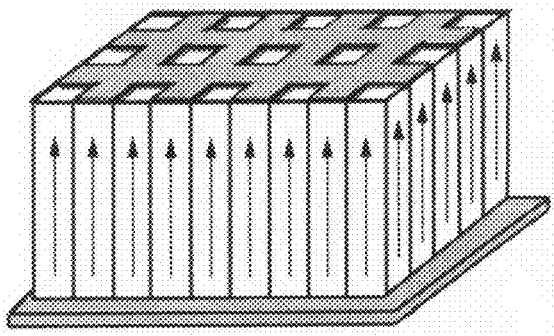
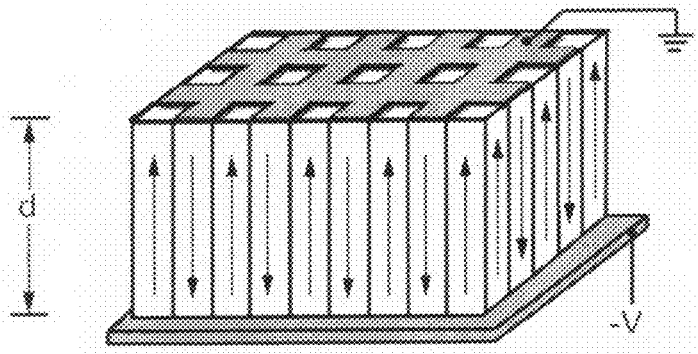
FIG. 1B
Voltage applied such that $|V/d| > E_c$
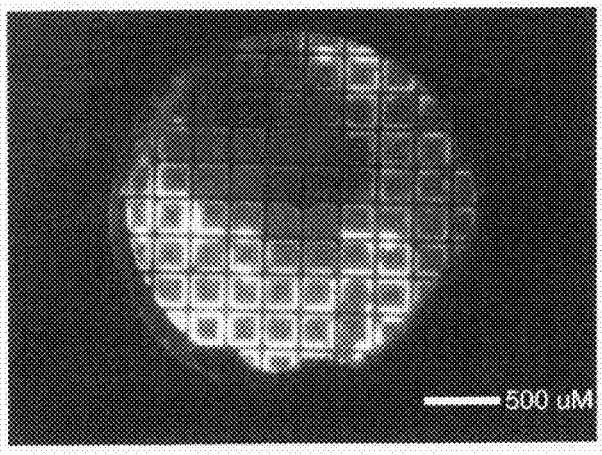
FIG. 1C FIG. 2A
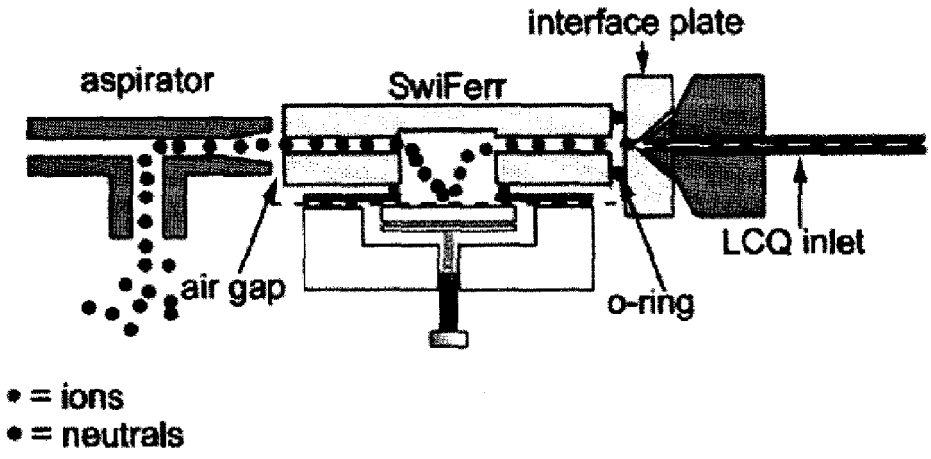
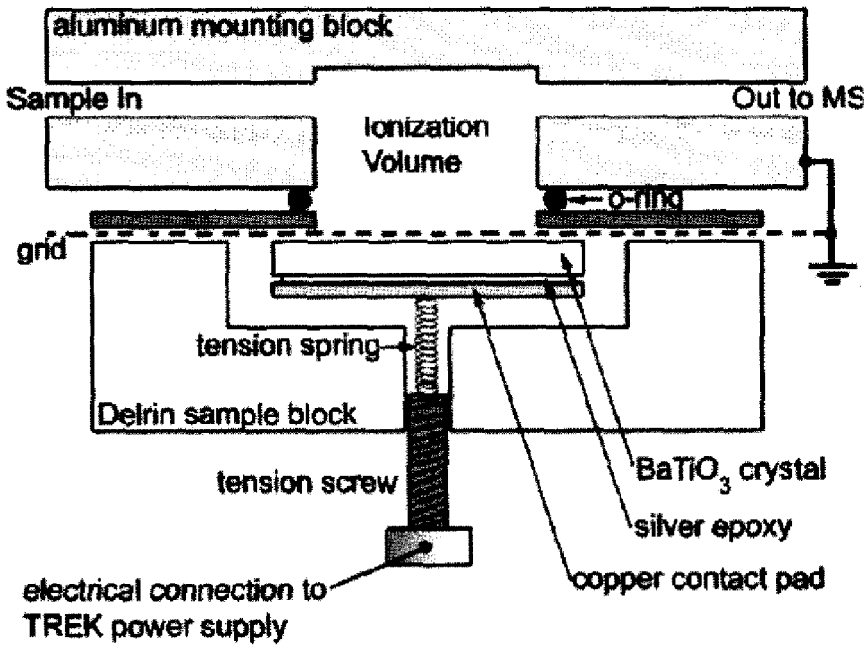
FIG. 2B FIG. 3A
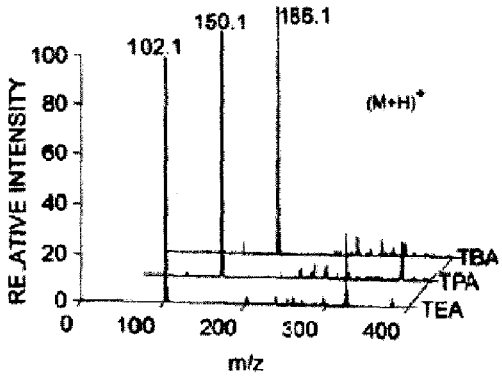
FIG. 3B
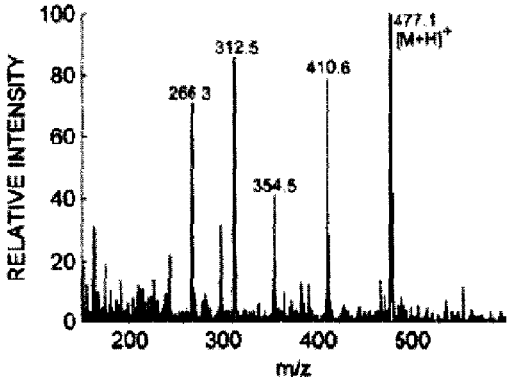
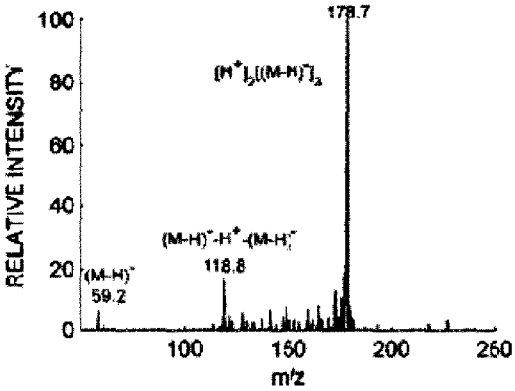
FIG. 3C
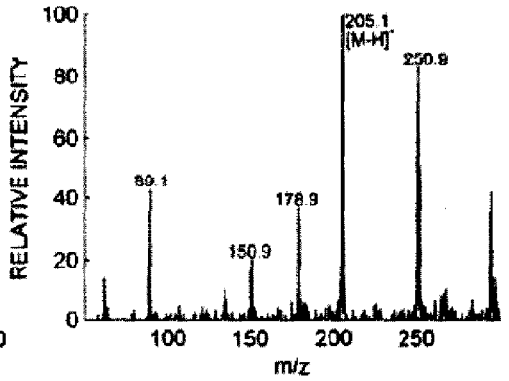
FIG. 3D FIG. 4A
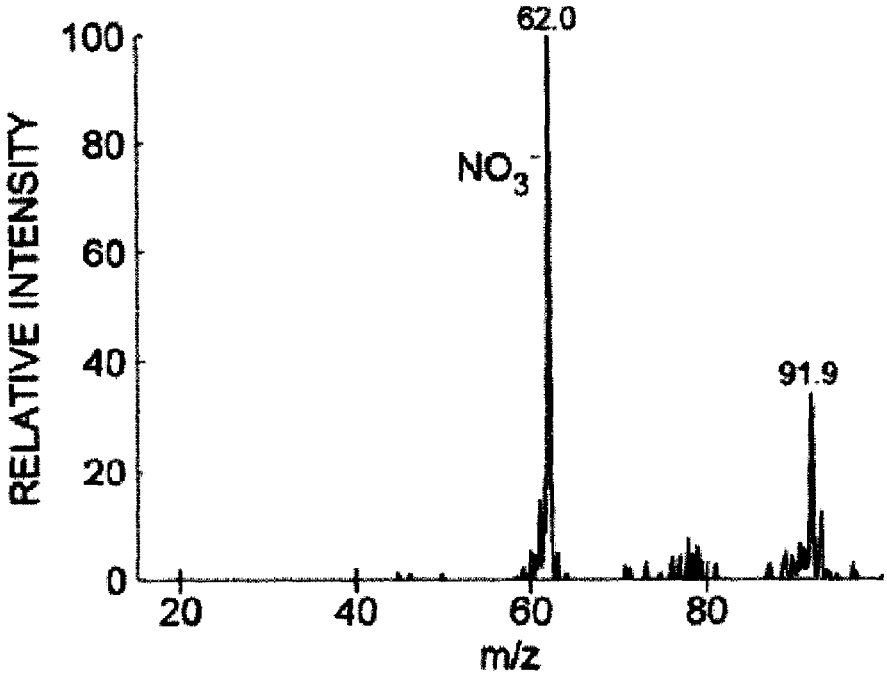
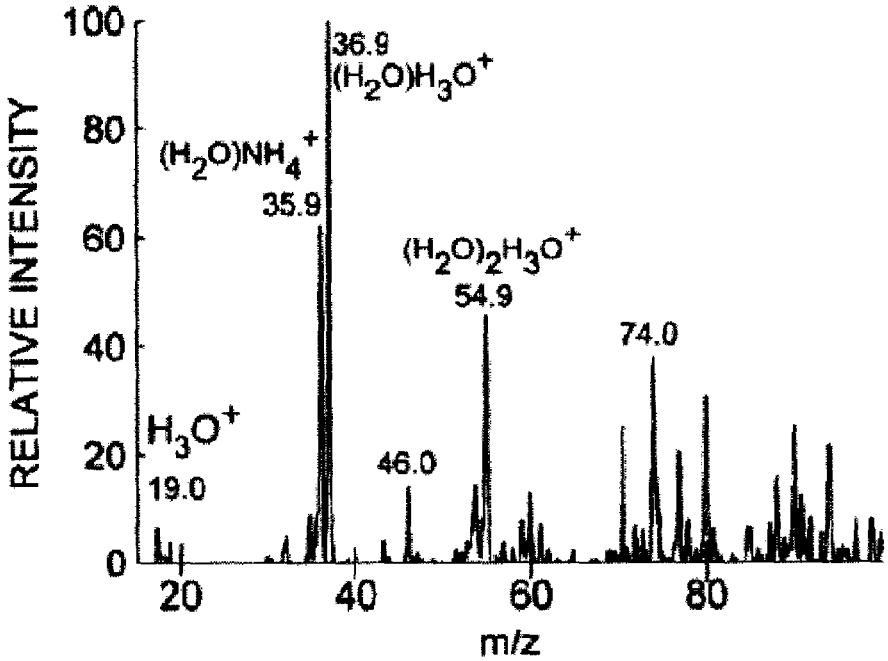
FIG. 4B

SWITCHED FERROELECTRIC PLASMA IONIZER

CROSS-REFERENCE TO RELATED APPLICATIONS

This application claims priority to and the benefit of co-pending U.S. provisional patent application Ser. No. 61/229,700 filed Jul. 29, 2009, which application is incorporated herein by reference in its entirety.

STATEMENT REGARDING FEDERALLY FUNDED RESEARCH OR DEVELOPMENT

The U.S. Government has certain rights in this invention pursuant to Grant No. CHE0416381 awarded by the National Science Foundation.

FIELD OF THE INVENTION

The invention relates to ionization sources in general and particularly to an ionization source comprising a ferroelectric material.

BACKGROUND OF THE INVENTION

Ambient mass spectrometry has been defined practically as any method of ionization allowing for the sampling of an analyte from a surface or ambient atmosphere without advance sample preparation, occurring at ambient pressure. There are a number of somewhat distinct methodologies for ambient mass spectrometry. Several, like desorption electrospray ionization (DESI), (See Cooks, R. G.; Ouyang, Z.; Takats, Z.; Wiseman, J. M. *Science* 2006, 311, 1566-1570.) are derived primarily from electrospray ionization (ESI). Others utilize laser desorption to volatilize the sample, including ambient pressure matrix assisted laser desorption ionization (AP-MALDI). (See Laiko, V. V.; Baldwin, M. A.; Burlingame, A. L. *Anal. Chem.* 2000, 72, 652-657, and Laiko, V. V; Moyer, S. C.; Cotter, R. J. *Anal. Chem.* 2000, 72, 5239-5243.) These methodologies are combined in hybrid techniques which utilize both ESI and MALDI for sample volatilization and ionization, including MALDESI (See Sampson, J. S.; Hawkridge, A. M.; Muddiman, D. C. *J. Am. Soc. Mass Spec.* 2006, 17, 1712-1716.) and ELDI (See Sheia, J.; Huang, M.; Hsu, H.; Lee, C.; Yuan, C.; Beech, I.; Sunner, J. *Rapid Commun. Mass Spectrom.* 2005, 19, 3701-3704.).

Another category of prominent methods are electrical discharge or plasma based, and include the low temperature plasma probe, (See Harper, J. D.; Charipar, N. A.; Mulligan, C. C.; Zhang, X.; Cooks, R. G.; Ouyang, Z. Anal. Chem. 2008, 80, 9097-9104; and Zhang, Y.; Ma, X.; Zhang, S.; Yang, C.; Ouyang, Z.; Zhang, X. *Analyst* 2009, 134, 176-181.), direct analysis in real time (DART) (See Cody, R. B.; Laramee, J. A.; Durst, H. D. *Anal. Chem.* 2005, 77, 2297-2302.) and plasma-assisted desorption/ionization (PADI). (See Ratcliffe, L. V.; Rutten, F. J. M.; Barrett, D. A.; Whitmore, T.; Seymour, D.; Greenwood, C.; Aranda-Gonzalvo, Y.; Robinson, S.; McCoustra, M. Anal. Chem. 2007, 79, 6094-6101.) In just the last half decade, the field of ambient mass spectrometry has grown from just a few to nearly 40 different techniques. Excellent reviews on the subject of ambient ionization which give a comprehensive listing of the ionization sources available for both surface sampling (See Van Berkel, G. J.; Pasilis, S. P.; Ovchinnikova, O. *J. Mass Spectrom.* 2008, 43, 1161-1180.) and ambient (See Harris, G. A.; Nyadon, L.; Fernandez, F. M. *Analyst* 2008, 133, 1297-1301.) mass spectrometry as well as ion mobility spectrometry (See Guharay, S. K.; Dwivedi, P.; Hill, H. H. *IEEE Trans. Plasma Sci.* 2008, 36, 1458-1470.) are available.

There is a need for an efficient, small, low-power ionization source for mass spectrometry and other analytical applications.

SUMMARY OF THE INVENTION

According to one aspect, the invention features a switched ferroelectric plasma ionizer operable at ambient pressure. The switched ferroelectric plasma ionizer comprises a ferroelectric material having first and second surfaces on opposite sides thereof; a grid electrode disposed adjacent to the first surface of the ferroelectric material, the grid electrode having a connection terminal configured to be connected to a first terminal of a voltage source; a second electrode disposed adjacent to the second surface of the ferroelectric material, the second electrode having a connection terminal configured to be connected to a second terminal of a voltage source; and a housing disposed about the ferroelectric material, the grid electrode and the second electrode, the housing having an inlet port and an outlet port, the housing configured to contain at ambient pressure a volume of gas adjacent to the first surface ferroelectric material of the ferroelectric material.

In one embodiment, the ferroelectric material having first and second surfaces is a single crystal.

In one embodiment, the single crystal of the ferroelectric material having first and second surfaces is an oriented single crystal cut along a selected crystallographic direction.

In another embodiment, the oriented single crystal cut along a selected crystallographic direction is a [001] cut single crystal of $BaTiO_3$.

In yet another embodiment, the grid electrode is connected to ground potential.

In still another embodiment, the second electrode is connected to a terminal of a voltage source configured to provide an alternating voltage of sufficient magnitude to satisfy the relationship $|V/d|>E_c$ where V is an amplitude of an applied alternating voltage relative to ground, d is a thickness of the ferroelectric material between the grid electrode and the second electrode, and $E_c$ is a coercive field of the ferroelectric material.

In a further embodiment, the switched ferroelectric plasma ionizer is configured so that an application of the applied voltage of amplitude V is controlled by a programmable general purpose computer.

In yet a further embodiment, the inlet port of the housing is in fluid communication with a source of a material of interest to be analyzed.

In an additional embodiment, the outlet port of the housing is in fluid communication with an analyzer apparatus.

In one more embodiment, the analyzer apparatus is a mass spectrometer.

In still a further embodiment, the switched ferroelectric plasma ionizer further comprises a thermal desorption apparatus configured to produce a volatile component of interest from a liquid or a solid specimen, the thermal desorption apparatus having a outlet port in fluid communication with the inlet port of the housing.

According to another aspect, the invention relates to an ambient pressure gas analysis method. The ambient pressure gas analysis method comprises the steps of: exposing a gaseous sample of interest to a switched ferroelectric plasma ionizer operating at substantially ambient pressure, the switched ferroelectric plasma ionizer having a ferroelectric material having first and second surfaces on opposite sides of the ferroelectric material; a grid electrode disposed adjacent to the first surface of the ferroelectric material, the grid electrode having a connection terminal configured to be connected to a first terminal of a voltage source; a second electrode disposed adjacent to the second surface of the ferroelectric material, the second electrode having a connection terminal configured to be connected to a second terminal of a voltage source; and a housing disposed about the ferroelectric material, the grid electrode and the second electrode, the housing having an inlet port and an outlet port, the housing configured to contain at substantially ambient pressure the gaseous sample of interest adjacent to the first surface of the ferroelectric material; applying a ground potential to the grid electrode; applying an alternating voltage of sufficient magnitude to satisfy the relationship $|V/d|>E_c$ to the second electrode, where V is an amplitude of the applied alternating voltage relative to ground, d is a thickness of the ferroelectric material between the grid electrode and the second electrode, and $E_c$, is a coercive field of the ferroelectric material; analyzing an ionic species generated from the gaseous sample of interest to obtain a result; and performing at least one of recording the result, transmitting the result to a data handling system, or to displaying the result to a user.

In one embodiment, the ferroelectric material having first and second surfaces is a single crystal.

In another embodiment, the single crystal is an oriented single crystal cut along a selected crystallographic direction.

In yet another embodiment, the oriented single crystal cut along a selected crystallographic direction is a [001] cut single crystal of $BaTiO_3$.

In still another embodiment, the step of applying the alternating voltage is controlled by a programmable general purpose computer.

In a further embodiment, the step of analyzing an ionic species is controlled by a programmable general purpose computer.

In yet a further embodiment, the step of performing at least one of recording the result, transmitting the result to a data handling system, or to displaying the result to a user is performed by a programmable general purpose computer.

In an additional embodiment, the step of analyzing an ionic species is performed using a mass spectrometer.

In one more embodiment, the ambient pressure gas analysis method further comprises the step of producing a volatile component of interest from a liquid or a solid specimen in a thermal desorption apparatus and supplying the volatile component of interest as the gaseous sample of interest.

In another embodiment, the step of exposing a gaseous sample of interest comprises exposing a gaseous sample derived by passing a carrier gas over a solid sample to produce the sample of interest.

In another embodiment, the step of exposing a gaseous sample of interest comprises exposing a gaseous sample that includes fine particles (e.g., particles having dimensions of microns, or aerosols) entrained therein as the sample of interest.

In still a further embodiment, the step of exposing a gaseous sample of interest comprises exposing a gaseous sample derived from a human breath as the sample of interest.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 1A is a schematic diagram illustrating a ferroelectric crystal with uniform polarization, where the polarization of all regions is identical. A grid electrode is shown on one face of the crystal and a plane electrode is shown on the opposite face.

FIG. 1B is a schematic diagram illustrating a crystal with formed domains as a result of ferroelectric switching. Domain walls, or boundaries between regions of opposite polarization, are formed. At the surface of the material, an electric field exists across the domain wall.

FIG. 1C is a 45 second exposure photograph of visible light from plasma arising near the grid when the polarization of a ferroelectric crystal is switched at ambient pressure.

FIG. 2A is a schematic diagram of the source arrangement in front of the mass spectrometer inlet. The source is attached to the atmospheric pressure inlet capillary using a machined interface plate. An air gap is maintained between the aspirator exhaust and source inlet.

FIG. 2B is a schematic diagram illustrating the source in greater detail.

FIG. 3A is a diagram that illustrates positive mode mass spectra of triethylamine, tripropylamine, and tributylamine ionized with SwiFerr, in which the singly protonated quasi-molecular ion $(M+H)^+$ is observed for each amine.

FIG. 3B is a diagram that illustrates a positive mode mass spectrum of a ground tablet of loperamide ionized with SwiFerr, in which protonated loperamide is observed as the base peak in the mass spectrum.

FIG. 3C is a diagram that illustrates a negative mode mass spectrum of acetic acid vapor obtained using SwiFerr, in which monomeric deprotonated acetic acid (m/z 59.2) as well as the deprotonated dimer (m/z 118.8) and trimer (m/z 178.7) are observed.

FIG. 3D is a diagram that illustrates a negative mode mass spectrum of a ground tablet of ibuprofen ionized with SwiFerr, in which deprotonated ibuprofen (m/z 207) is observed as the base peak in the mass spectrum. The peak at 250.9 is suspected to be due to the polymeric tablet coating.

FIG. 4A is a diagram that illustrates the negative mode mass spectrum of reagent ions resultant from the operation of SwiFerr in air, in which nitrate anion was observed, and can take part in proton transfer reactions which ionize neutrals.

FIG. 4B is a diagram that illustrates the positive mode mass spectrum of ions resultant from the operation of SwiFerr in air, in which hydrated protons (clusters of neutral water molecules and hydronium ion) are present which can take part in proton transfer reactions which ionize neutrals. Peaks at higher mass are likely due to the ionization of impurities present in laboratory air.

DETAILED DESCRIPTION

Figure 3E:
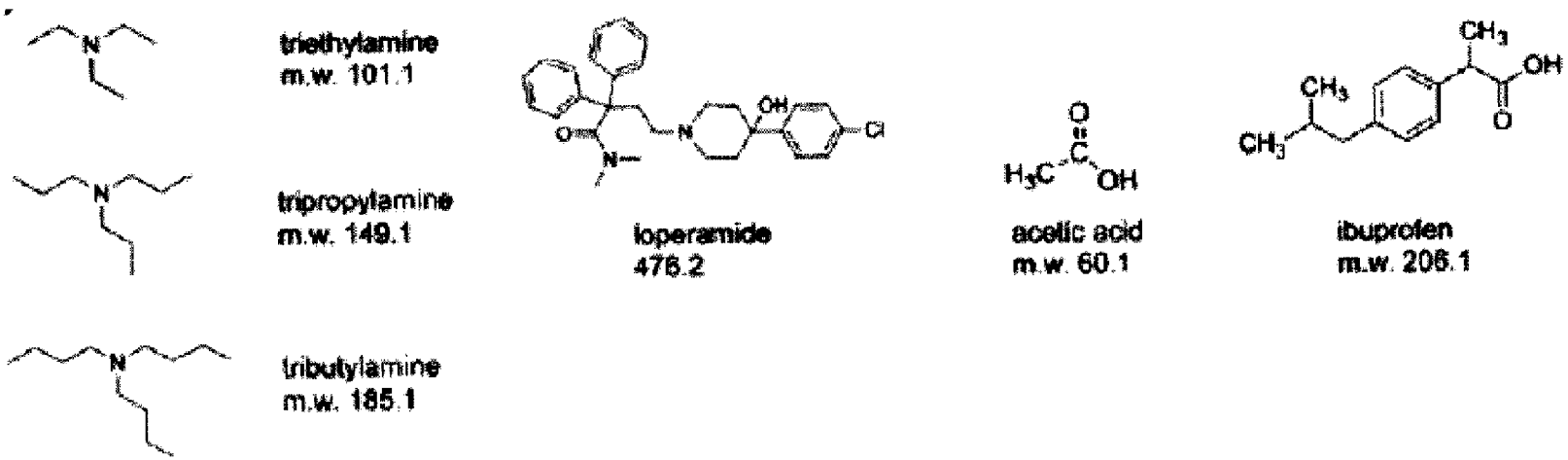
FIG. 3E is a diagram that illustrates the chemical structures and molecular Weights for the species in FIG. 3A through FIG. 3D.

The implementation of a switched ferroelectric plasma ionizer (SwiFerr) for ambient analysis of trace substances by mass spectrometry is presented. The device utilizes the ferroelectric properties of barium titanate ($BaTiO_3$) to take advantage of the high electric field resulting from polarization switching in the material. The source comprises a [001] oriented barium titanate crystal (in one embodiment, 5×5×1 mm) with a metallic rear electrode and a metallic grid front electrode. When a high voltage AC waveform is applied to the rear electrode to switch polarization, the resulting electric field on the face of the crystal promotes electron emission and results in plasma formation between the crystal face and the grounded grid at ambient pressure. Interaction with this plasma and the resulting reagent ions effects ionization of trace neutrals. The source requires less than one watt of power to operate under most circumstances, ionizes molecules with acidic and basic functional groups easily, and has proven quite versatile for ambient analysis of both vapor phase and solid phase samples. Ionization of vapor phase samples of the organics triethylamine, tripropylamine, and tributylamine, and pyridine results in observation of the singly protonated species in the positive ion mass spectrum with sensitivity extending into the low ppm range. With acetic acid, deprotonated clusters dominate the negative ion mass spectrum. Aerodynamic sampling of powdered samples was used to record mass spectra of the pharmaceuticals loperamide and ibuprofen. Chemical signatures, including protonated loperamide and ibuprofen, are observed for each drug. The robust, low-power source, which requires no reagent gases or solvents, lends itself easily to miniaturization and incorporation in field portable devices used for the rapid detection and characterization of trace substances and hazardous materials in a range of different environments. While the examples shown and described in various embodiments use single crystal $BaTiO_3$ cut in a specific orientation, it is expected that switched ferroelectric plasma ionizer devices can be constructed and operated which employ polycrystalline ferroelectric materials, such as ferroelectric ceramics, and which comprise ferroelectric materials different from $BaTiO_3$, such as lithium niobate, triglycine sulfate, lead titanate ($PbTiO_3$), lead zirconate titanate (PZT), lead lanthanum zirconate titanate (PLZT), and others.

The switched ferroelectric plasma ionizer is conceptually distinct from other discharge ion sources and consumes significantly less power than other devices. The use of a switched ferroelectric material is believed to be novel to the field of ambient pressure ionization for mass spectrometry. The importance of the device is to provide a convenient, low power method of producing ions for ambient mass spectrometric analysis without requiring consumable reagents or radioactive materials. A popular ionization source for many purposes is radioactive Nickel-63 ($^{63}Ni$) or Americium-241 ($^{241}Am$) foil, yet handling and transporting this material is subject to safety concerns and regulatory requirements. Eliminating the use of $^{63}Ni$ is a high priority. The source (like many other discharge-based ionization techniques) relies on chemical ionization as its chief mode of ionization, which is a very sensitive technique and lends itself readily to analytical methods for detecting trace substances.

An ambient pressure pyroelectric ionization source (APPIS) for mass spectrometry based on pyroelectric lithium tantalate has been described in U.S. patent application Ser. No. 11/972,754 filed Jan. 11, 2008, and published as US Patent Application Publication No. 2008/0179514 A1. Owing to their non-centrosymmetric crystal structure, pyroelectric materials possess a spontaneous polarization $P_s$ which changes in magnitude with temperature change. The lithium tantalate material used in the APPIS source is also ferroelectric, another property dependent on a non-centrosymmetric crystal structure. Ferroelectric materials are unique in that they have a spontaneous polarization which is electrically switchable. The net polarization of a substance is a consequence of crystal structure asymmetry leading to a net dipole in the unit cell of the material. A material is uniformly polarized when all regions have the same polarization, as in FIG. 1A. Because the material is ferroelectric, the polarization of any region can be changed by applying an electric field greater than the coercive field $E_c$. If a grid electrode is present, such as in FIG. 1B, regions with different orientations of $P_s$ (termed 'domains') are formed. The coercive field varies from material to material, and is dependent on the dielectric constant of the material in the direction of polarization as well as the bulk spontaneous polarization.

$$E_C = \frac{2}{3\sqrt{3}}\sqrt{\frac{\alpha^3}{\beta}} \approx 0.385\,\alpha P_s \qquad \text{Eqn. (1)}$$

Equation 1 is an expression for calculating the coercive field for a material, where $\alpha=1/(2\in_{ij})$, $\beta\approx\alpha/P_S^2$, and $\in_{ij}$ is the dielectric constant in the direction of polarization. Experimentally determined values for $E_C$ are often one order of magnitude or more lower than calculated values, owing to physical processes occurring during domain wall formation, as discussed by Kim and co-workers. (See Kim, S.; Gopalan, V.; Gruverman, A. *Appl. Phys. Lett.* 2002, 80, 2740-2742.) Experimentally, a coercive field of 20 kV $mm^{-1}$ is found for lithium niobate (See Gopalan, V.; Mitchel, T. E.; Furukawa, Y.; Kitamura, K. *Appl. Phys. Lett.* 1998, 72, 1981-1983.) while a field as little as 100 V $mm^{-1}$ is found for triglycine sulfate. (See Biedrzycki, K.; Markowski, L.; Czapla, Z. *Physica Stat. Sol. A* 1998, 165, 283-293.) Barium titanate ($BaTiO_3$) has a coercive field of approximately 500 V $mm^{-1}$. (See Latham, R. V. *Brit. J. Appl. Phys.* 1967, 18, 1383-1388.)

A plasma can arise on the surface of a switched ferroelectric material as a consequence of electron emission resulting from the large electric field created across domain walls when a switching electrode is nearby, as in FIG. 1C. Ferroelectric electron emission is a well known and well studied phenomenon (See Rosenman, G.; Shur, D.; Krasik, Y. E.; Dunaevsky, A. J. *Appl. Phys.* 2000, 88, 6109-6161.) that results in ionization of gases at both reduced (ultra high vacuum) and ambient pressures. Switched ferroelectric plasmas resulting from electron emission have been used previously in a number of applications, mainly involving high current electron emitters. (See Krasik, Y. E. *IEEE Trans. Plasma. Sci.* 2003, 31, 49-59.) Although several reports of ion production by switched ferroelectrics at reduced pressure have been published, (See Dunaevsky, A.; Krasik, Y a. E.; Felsteiner, J.; Dorfman, S. *J. Appl. Phys.* 1999, 85, 8464-8473; Sroubek, Z. *J. Appl. Phys.* 2000, 88, 4452-4454; Sroubek, Z. *Appl. Phys. Lett.* 2002, 80, 838-840; and Chirko, K.; Krasik, E.; Felsteiner, J. J. Appl. Phys. 2002, 91, 9487-9493.) ambient pressure plasma formation has not previously been used as a source of ions for ambient mass spectrometric analysis. Ambient pressure plasma formation has been discussed by Kusz, J.; Musielok, J.; Wanik, B. *Beitr. Plasmaphysik* 1982, 22, 381-386; Janus, H.; Kusz, J.; Musielok, J. *Beitr. Plasmaphysic* 1985, 25, 277-288; Biedrzycki, K. *J. Phys. Chem. Solids* 1991, 52, 1031-1035; and Goly, A.; Lopatka, G.; Wujec, *T. J. Quant. Spectrosc. Radix. Transfer* 1992, 47, 353-358.

Embodiment 1

Design and Construction of Swiferr Ionizer

FIG. 2A is a schematic diagram of the source arrangement in front of the mass spectrometer inlet. The ion source is attached to the atmospheric pressure inlet of an LCQ Deca XP ion trap mass spectrometer using a machined interface plate. Vapor or aerosol samples are drawn into the source due to the gas flow induced by the atmospheric pressure sampling capillary being backed by vacuum. An air gap of 1-2 mm is maintained between the source sample inlet and aspirator exhaust so that the source is not pressurized when the aspirator is operated using compressed air.

FIG. 2B is a detailed schematic of a preferred embodiment of the SwiFerr source. The device illustrated utilizes a 5×5×1 mm sample of single crystal barium titanate oriented in the [001] direction with one face polished (MTI Corporation, Richmond, Calif., USA). Barium titanate has three phase transition temperatures, or Curie temperatures, and four phases, three of which are ferroelectric. Below 183 K, $BaTiO_3$ is rhombohedral, polarized along the [111] axis. From 183 K to 278 K it is orthorhombic, polarized along the [011] axis. From 278 K to 393 K, $BaTiO_3$ is tetragonal and polarized along the [001] axis and this is the orientation used in the current application owing to its intended use as an ionizer at ambient temperature and pressure. At high temperature, $BaTiO_3$ is stable in a paraelectric cubic structure. A contact pad comprising a 4.8 mm diameter disc cut from a 0.5 mm thick oxygen-free copper sheet is attached to the unpolished side of the crystal using silver conducting epoxy (MG Chemicals, Toronto, Ontario, Canada). A layer of silver epoxy achieving full coverage of the crystal face is first applied and allowed to cure before the contact pad is bonded using a second application of silver epoxy. The crystal with contact pad on one side is placed in a sample holder block machined from white Delrin, and a piece of woven copper mesh (0.230 mm diameter wire and 0.630 mm wire spacing) larger than the crystal surface area is placed on top of the face that does not have an electrode. Electrical connections to the source are made using the tension screw (connection point for high voltage waveform) and the grid. When affixed to the mass spectrometer, sample is drawn into the 'sample in' port, passed through the ionization volume where ionization occurs, and exits the source and enters the mass spectrometer. The grid and mounting block are maintained at ground potential throughout the operation. An aperture plate (SS-PL-B-R187, Kimball Physics, Wilton, N.H. USA) is placed on top of the copper mesh. The aperture plate is vibrationally isolated from the aluminum mounting block using a silicone o-ring.

While the description given for specific embodiments are presented using the tetragonal form of $BaTiO_3$ polarized along the [001] axis and operated in air at room temperature (approximately 298 K), it is specifically contemplated that embodiments can be designed for operation at temperatures in the ranges of 183 K to 278 K and below 183 K by using specimens of $BaTiO_3$ that are cut and polarized in the correct orientations. It is also contemplated that other known ferroelectric materials can be employed if the material is correctly oriented and cut for the range of temperature contemplated, and if suitable switching signals are applied to the material using electrodes as described herein.

Ions were detected using a Thermo Scientific LCQ Deca XP ion trap mass spectrometer without modification other than the electrospray source being removed and replaced with the SwiFerr. Inlet capillary temperature was 40-70° C., and the capillary was held at ground potential. To operate the source, an audio frequency high voltage sine wave was applied to the rear electrode of the barium titanate sample by making an electrical connection to the tension screw, while the copper mesh and aperture plate were maintained at ground potential by making an electrical connection to the mesh electrode. The waveform was generated using a TREK PM101494A high voltage amplifier/generator (TREK Inc, Medina, N.Y., USA) and can be varied in frequency from 0.1 to 10 kHz and in voltage from 0 to 20 kV p-p for testing purposes.

Chemical Handling

All chemicals were used as received, without further purification. Sample concentrations, when not specified, are unknown owing to the fact that the sample used was vapor resulting from the room temperature vapor pressure of the sample being tested, or aerosol particles in the case of sampled solids. For pharmaceutical sampling, a tablet of each drug was ground in a mortar and pestle before sampling. The tablets were commercial samples obtained from drug stores, rather than being pure samples of the active pharmaceutical ingredient purchased from a chemical supplier.

Ambient Ionization of Vapor Phase and Solid Samples

The SwiFerr ionization source was used to ionize and detect a variety of samples ranging from organic vapors to samples of drug tablets. Both cations and anions are produced by the source, and the ion signal observed appears continuous when an ion trap mass spectrometer is used for detection. FIG. 3A shows mass spectra of the amines triethylamine, tripropylamine, and tributylamine ionized by SwiFerr under ambient conditions. The samples were introduced as neat vapor at room temperature. Each amine was detected as a singly protonated quasimolecular $(M+H)^+$ ion, owing to the basicity of tertiary amines. An aerodynamic sampling arrangement utilizing a pneumatic aspirator similar to that of Dixon (See Dixon, R. B.; Sampson, J. S.; Hawkridge, A. M.; Muddiman, D. C. *Anal. Chem.* 2008, 80, 5266-5271.) was used to sample powder from drug tablets. A tablet containing the pharmaceutical compound loperamide was crushed in a mortar and pestle and ground to a fine powder. The powder was aspirated into the SwiFerr source and the peak for loperamide was observed as the base peak in the mass spectrum (FIG. 3B). Whether this is the result of particles interacting directly with the plasma or the detection of trace vapor phase species is not known. Like the vapor phase samples, loperamide also contains tertiary amine functionality and was detected as the singly protonated species in the mass spectrum. FIG. 3C is an example of negative ion production with SwiFerr for a vapor phase sample of acetic acid. Deprotonated clusters of the acid dominate the SwiFerr mass spectrum. The drug ibuprofen was aerodynamically sampled and detected using SwiFerr in the same manner as loperamide, except that anions were analyzed. Ibuprofen was detected as the singly deprotonated species in the mass spectrum (FIG. 3D) owing to the fact that it possesses carboxylic acid functionality. The ability of SwiFerr to ionize acids and bases by deprotonation and protonation, respectively, suggests chemical ionization as the chief ionization mode of the source. Reactant ions such as nitrate anion and hydrated protons are directly observed in experiments measuring ions resulting from the operation of the SwiFerr source in air (FIG. 4). The observed reactant ions take part in proton transfer reactions which can either deprotonate acids or protonate bases, and their presence indicates that the ionization mechanism operative in SwiFerr is ambient pressure chemical ionization, which is common for discharge based ion sources.

Limit of Detection for Organic Vapors

Figure 5:
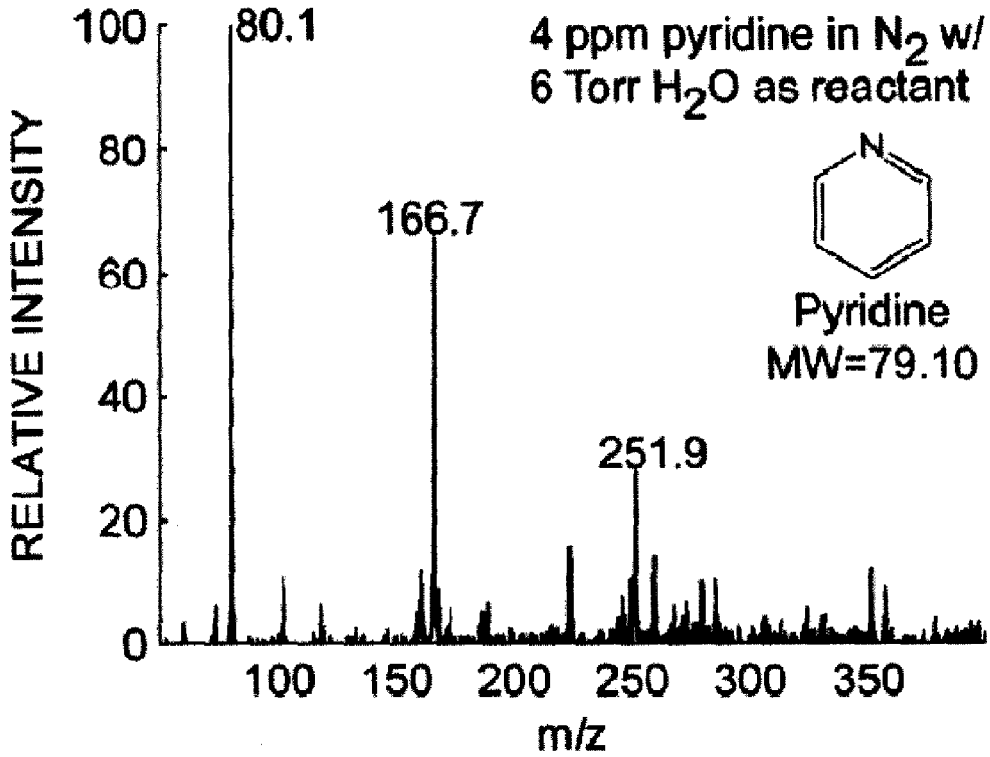
FIG. 5 is a diagram that illustrates the positive mode mass spectrum of 4 ppm pyridine in nitrogen doped with water, obtained with SwiFerr. The observed signal to noise indicates that the ultimate sensitivity of SwiFerr is in the part-per-billion range. Other peaks in the spectrum are believed to be due to impurities in the sampling system.
Figure 6:
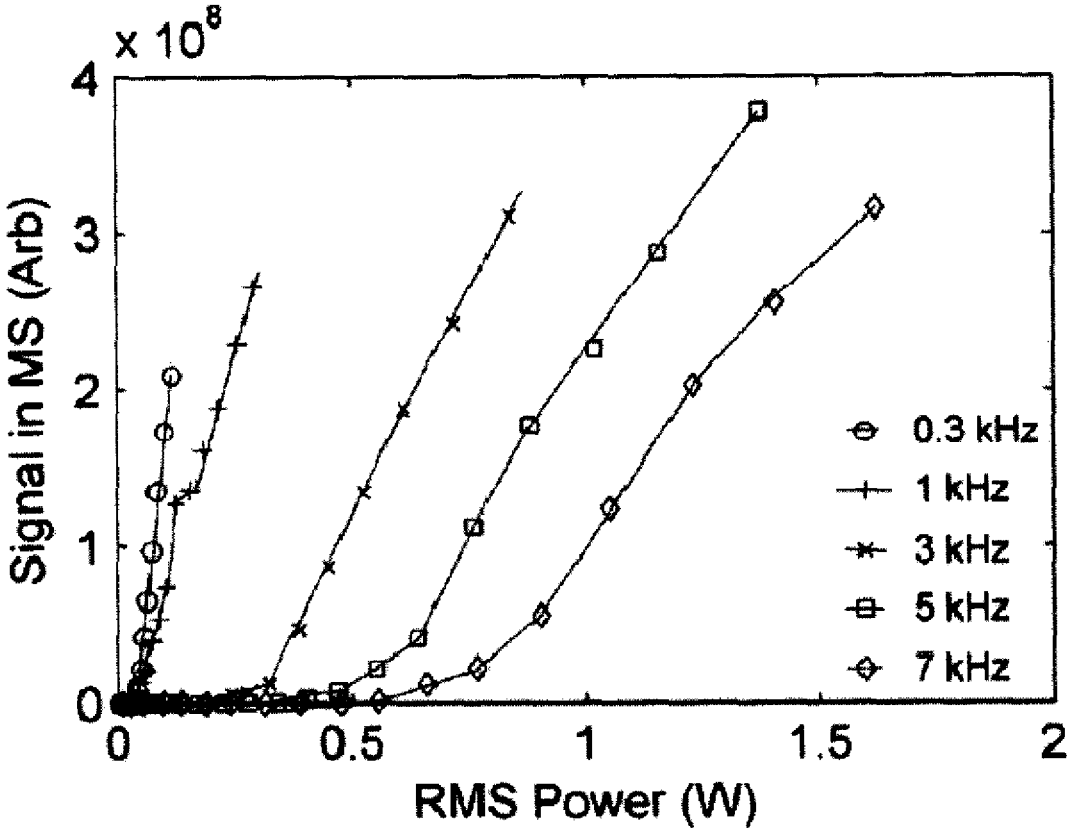
FIG. 6 is a diagram that illustrates the power consumption of the SwiFerr source, in which is shown a number of plots of total signal observed in the mass spectrometer for a sample of background lab air vs. RMS power for excitation of the crystal circuit at various frequencies. More efficient operation, minimizing power requirement, is obtained at lower frequencies.

Using the SwiFerr ion source implementation shown in FIG. 2, the limit of detection (LOD) for pyridine was investigated using a sample of pyridine in nitrogen containing 6 Torr water vapor to enhance proton transfer chemical ionization. Pyridine concentration was varied using a model 1010 gas diluter (Custom Sensor Solutions, Oro Valley, Ariz., USA) which allows for dilution of a prepared mixture by a factor of two to 50. In this case, a sample containing 50 ppm pyridine was prepared and mixtures containing from 25 to 1 ppm pyridine were available for analysis. FIG. 5 is a mass spectrum of pyridine at a concentration of 4 ppm. Protonated pyridine appears at 80.1 tn/z. Other peaks in the spectrum are trace impurities that do not result from ionization of pyridine. Detection of pyridine at 4 ppm with a signal/noise of approximately 50 indicates that the ultimate sensitivity of the ionizer in the present configuration is in the ppb range under optimal sampling conditions Optimization of Parameters for Source Operation Power consumption of the source was investigated by monitoring the RMS current required for source operation at various operating frequencies concurrently with ion signal observed in the mass spectrometer. Monitor functions on the TREK supply provided readings of RMS power as well as p-p voltage output. For a sample comprising laboratory air background, FIG. 6 shows RMS power consumption for source operation. More power is consumed during operation at higher frequencies with no increase in ion signal, indicating that the source operates more efficiently at lower frequency. The fact that the current flowing in the circuit driving the switched crystal (and thereby power consumption by the source) increases with frequency is a result of the series RC nature of the circuit. The crystal itself has a characteristic resistance and capacitance which acts like a series RC element.

$$P = \frac{V_{RMS}^2}{\sqrt{R^2 + X_C^2}},\ X_C \equiv \frac{1}{\omega C} \qquad \text{Eqn. (2)}$$

Equation 2 is an expression for the power flowing in the circuit, where R is the characteristic resistance and $X_C$ is the capacitive reactance. Capacitive reactance $X_C$ decreases with an increase in frequency, leading to a lower total impedance of the source ($\sqrt{R^2+X_C^2}$) and increased current flow through the circuit element. Understanding the behavior of the SwiFerr source in the electrical circuit allows for the selection of optimal operating parameters with respect to power consumption and ion signal intensity. Since no gain in observed ion signal results from operation at higher excitation powers, we typically operate the source at a frequency of 1 kHz and adjust the peak-to-peak excitation voltage to a level which produces a satisfactory ion signal for each specific experiment (typically below 350 V RMS). This corresponds to an ion source operating power of approximately 0.2 W for the present implementation of the SwiFerr plasma ionizer.

Embodiment 2

An alternative embodiment, comprising a miniaturized embodiment of the switched ferroelectric plasma ionizer (SwiFerr) is now presented. An ion source and housing half the size and more durable than the original design was constructed and tested with organic vapors and solid samples. The revised source design fits inside the bore of a modified ⅛" Swagelok tee fitting, which allows for the construction of a sealed source. Sealing the ion source allows for good sensitivity by increasing the probability of interaction between reagent ions and analytes. The miniaturized source is constructed in a unibody fashion using appropriate conductive and non-conductive adhesives and does not require external mounting hardware, which had been a source of contamination. An application of the new source design is presented which is the detection of nanogram quantities of explosives. Trinitrotoluene (TNT) was introduced into the source using a rudimentary thermal desorption apparatus and ionization by SwiFerr produced the TNT radical anion which was detected with good sensitivity. The source consumes approximately 0.4 W of power under normal operation, which is well within the acceptable range for sources used in field portable instrumentation. Increased power usage for the miniaturized design relative to the original design is likely due to increased capacitance in the source, the source of which is most likely more efficient polarization switching and plasma production.

Continuous development in ambient pressure ionization sources has brought about the APPIS and SwiFerr sources. Demonstrated applications of these sources include the analysis of generic organic vapors, chemical warfare agents, and the sampling of unknown powders by aspiration followed by analysis by mass spectrometry. An application not yet addressed has been the detection of various explosives materials using mass spectrometry, with ionization by either APPIS or SwiFerr. Some explosives, such as RDX or PETN, are detected as singly protonated cations and both APPIS and SwiFerr ionize in suitable fashion as to be able to detect such chemicals. Reagent ions such as hydrated protons and ammonium cation are produced which can participate in proton transfer reactions with analytes having higher proton affinity than water, and are detected as cations. Other explosives, such as the nitrotoluenes and nitrobenzenes, are generally detected as anions, sometimes as singly deprotonated ions or as radical anions formed by electron attachment. The former case has been demonstrated with benzoic acid, hexafluoroisopropanol, and acetic acid; the case with electron attachment has not yet been demonstrated with APPIS or SwiFerr. Since both are electrical discharge based, and the electrical discharge arises from either high negative potentials on the crystal face (APPIS) or ferroelectric switching (SwiFerr) and both cases have been shown to produce free electrons, it should be possible to form radical anions by electron attachment using SwiFerr.

Figure 7:
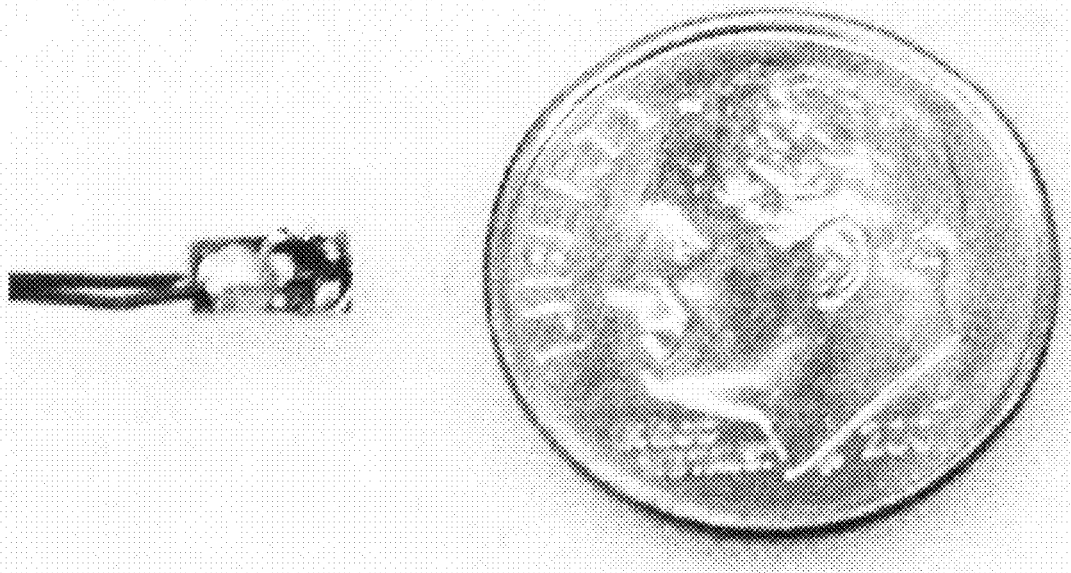
FIG. 7 is an illustration of a miniaturized SwiFerr source with a U.S. ten cent coin for scale.

In the first embodiment presented, mounting and electrical connections for the source are achieved with machined parts, and sealing of the source is achieved using o-rings. When occasions of high analyte concentration occurred, the source can become contaminated owing to the many surfaces for adsorption. In order to improve source performance, protect from contamination, and achieve further miniaturization, a modified construction of the SwiFerr source was made using a crystal half the size of the previous with different electrodding and electrical contacting methods. The present embodiment of the SwiFerr source comprises a 2.5×5×1 mm thick barium titanate crystal with front and rear electrodes as well as electrical contacts constructed in a unibody fashion. The housing for the source is a modified Swagelok tee fitting which not only contributes to improved sealing of the source but also aids in easily integrating SwiFerr into existing systems. FIG. 7 is a photograph showing the source outside its housing, next to a dime for scale. The present embodiment of the SwiFerr source exhibits good sensitivity. An application in which trace quantities of explosives are detected following thermal desorption is presented. Trinitrotoluene was introduced into the source using a rudimentary thermal desorption apparatus, and ionized by SwiFerr. The anion of TNT, as well as a peak corresponding to the loss of NO, was observed and is consistent with previous work on TNT using ambient ionization. Power consumption and capacitance measurements were made to characterize the source electrically.

Figure 8A:
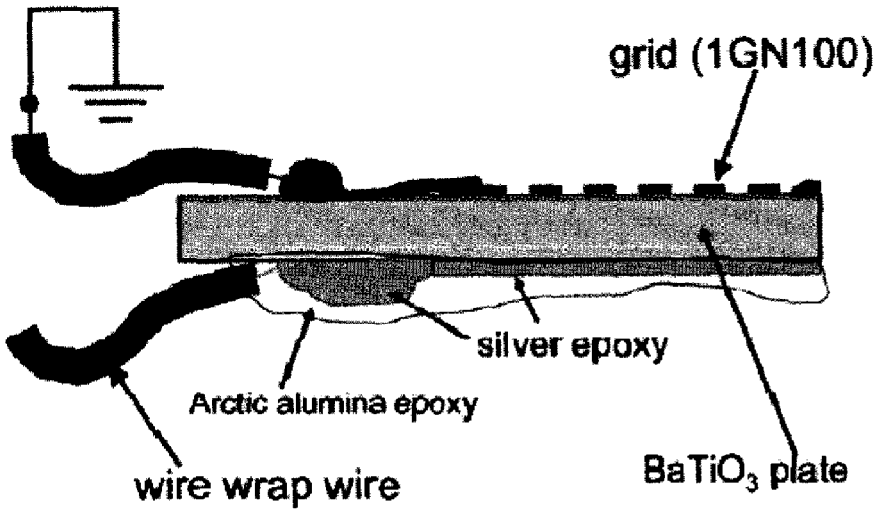
FIG. 8A is a schematic diagram illustrating in cross section a second-generation SwiFerr ion source, in which a 2.5×5×5 $BaTiO_3$ crystal has electrodes, a grid, and electrical contact wires attached using silver conducting epoxy.

FIG. 8A is a schematic diagram illustrating in cross section a second preferred embodiment of a SwiFerr ion source, in which a 2.5×5×5 $BaTiO_3$ crystal has electrodes, a grid, and electrical contact wires attached using silver conducting epoxy. The high voltage side of the source is potted with Arctic Alumina thermal adhesive, which is non-conducting. Electrical contact wires are Kynar insulated wire-wrap wire.

Figure 8B:
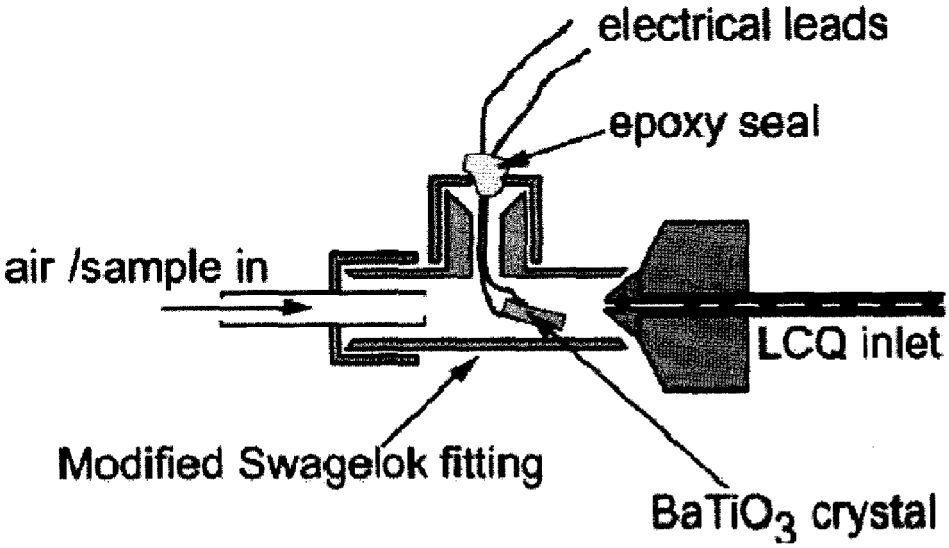
FIG. 8B is a schematic diagram illustrating in cross section a crystal assembly of FIG. 8A that is inserted into a ⅛" Swagelok tee fitting which has been modified by drilling the main bore out to 4.8 mm.

FIG. 8B shows the source arrangement in front of the mass spectrometer. To construct the source, a rear electrode of silver conducting epoxy (MG Chemicals, Toronto, Ontario, Canada) was applied to the unpolished side of the crystal. To apply the electrode, a mask of Scotch tape was used to create a rectangular area on the unpolished side of the sample so that a thin layer of the epoxy can be wiped onto the crystal. After ten minutes, the mask is removed, leaving a rectangular electrode on one side of the crystal. Suitable curing time is allowed for the electrode before affixing the grid to the other side. The grid used is a nickel transmission electron microscope (TEM) grid (1GN100, Ted Pella Company, Redding, Calif., USA). Three small spots of silver epoxy are applied to the polished side of the crystal, and the grid is laid onto those spots and pressed so that the maximum amount of contact is achieved between the grid and crystal face. Suitable cure time for the grid adhesive is allowed before beginning to affix contact wires to the assembly. The rear contact wire is affixed using silver epoxy. The wires used were Kynar insulated wire used for wire-wrap electronics construction. The Kynar insulation has sufficient dielectric strength that voltages on the order of 500 V RMS can be used without sparking if the insulation comes in contact with a grounded surface. After the rear electrode wire is attached, suitable cure time is allowed before attaching the wire to the front grid. Electrical contacting to the front grid is achieved again with silver epoxy. The wire is attached to the crystal face near the grid, and a track of epoxy connects the grid to the wire. The last step in source construction is to pot the rear high voltage electrode with Arctic Alumina thermal adhesive (Arctic Silver, Visalia, Calif., USA) so that the source can be placed in contact with grounded metal. After the source is sufficiently insulated with the thermal adhesive and the adhesive is allowed to cure for a sufficient amount of time, it can be inserted into its housing.

A housing was constructed from a ⅛" Swagelok tee fitting having a bore which was drilled out to a diameter of 4.8 mm so that the source could be inserted into it. The source was inserted such that the wires came out the top of the tee fitting, and the end of the source was approximately 6 mm from the end of the fitting. This allows for tubing connections to the output of the source. The wires were fed through a ⅛" OD, 1/16" ID section of polyethylene tubing and sealed off using 5 minute epoxy. The housing was held in front of the atmospheric pressure inlet of a Thermo Scientific LCQ Deca XP ion trap mass spectrometer using clamps. Gas flow rate through the source was 1000 SCCM compressed air which was from the air compressor serving the lab building. The source was operated with a 900 V p-p sine wave at a frequency of 1 kHz from a TREK high voltage power supply/generator (TREK Inc, Medina, N.Y., USA). In operation, a carrier gas such as air and sample to be analyzed come in one side of the tee fitting, pass near the crystal and plasma, and exit the fitting into the ion trap mass spectrometer. While operation in ambient air is a desired operating condition, as operating conditions may require, the carrier gas can be any convenient gas, such as air, inert gas such as He or Ar, substantially pure elemental gases such as $O_2$ or $N_2$, or gases containing specific gas mixtures.

Thermal desorption for the operation of the SwiFerr to demonstrate operation with explosives and other solid samples was achieved using a home-built apparatus. The device was constructed from a stainless steel Swagelok tee fitting which had been modified to accept a Thorlabs 15W cartridge heater. A slot was milled in the bottom portion of the fitting and the heater and a 10k thermistor were attached to the fitting using Arctic Alumina thermal adhesive. A Thorlabs TC200 temperature control unit was used to apply a temperature step function to the fitting, raising the temperature from 25° C. to 100° C. in approximately 20 seconds, which was sufficient for volatilization of small quantities of analyte. Analyte was deposited through the top port of the fitting with the gas flow turned off. Each chemical was present as a solution in acetonitrile. A 2 μL sample of solution was spotted onto the interior of the fitting and allowed to dry with gas flow turned off. The thermal desorption cell was then sealed and the gas flow turned on, followed by the heating which sublimed the sample. Ionization was achieved using SwiFerr, followed by detection in the ion trap mass spectrometer.

TNT was obtained from Sigma Aldrich (St. Louis, Mo., USA) as a 1 mg/mL solution in acetonitrile. Serial dilution was used for preparing working solutions of TNT so that a 2 μL aliquot would allow for the deposition of nanogram quantities of the explosive. 4-cyanobenzoic acid was from Sigma. Samples for determination of detection limits for organic vapors were prepared by on-line dilution using a Model 1010 gas diluter (Custom Sensor Solutions, Oro Valley, Ariz.). Samples of diethyl ether were prepared by injecting 1 μL liquid diethyl ether into a 40 L capacity Tedlar sample bag, which was then filled with 33 L of air from the compressor supplying the lab building. The sample bag was then connected to the sample input of the gas diluter, whose output was then connected to the gas inlet port of the SwiFerr source. Dilutions were performed with a diluent bag also containing air from the laboratory supply. The gas diluter has useable dilution settings from 2% to 100%, meaning available concentration ranged from 2 to 100 percent of the prepared concentration.

Figure 9:
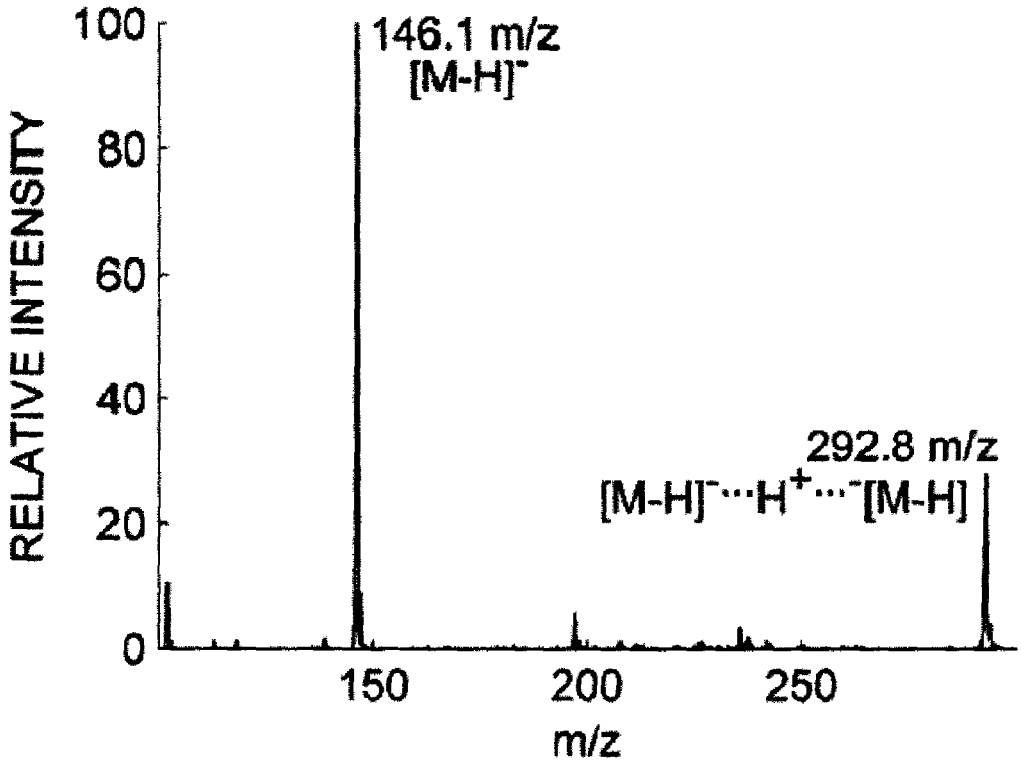
FIG. 9 is a diagram that illustrates the mass spectrum of 4-cyanobenzoic acid by thermal desorption SwiFerr mass spectrometry.

As one example of operating capability of the thermal desorption apparatus, 4-cyanobenzoic acid was thermally desorbed and detected using SwiFerr. FIG. 9 is a negative ion mass spectrum of thermally desorbed 4-cyanobenzoic acid, showing both the deprotonated acid as well as the proton bound dimer of the deprotonated acid. Good signal-to-noise was achieved for the measurement for a temperature change of approximately 100° C. The acid was not expected to have significant vapor pressure relative to atmospheric pressure at room temperature, and a peak corresponding to the acid was not observed before heating. The successful detection of the substituted benzoic acid suggests that this thermal desorption apparatus is suitable for general use with nominally nonvolatile materials.

Figure 10:
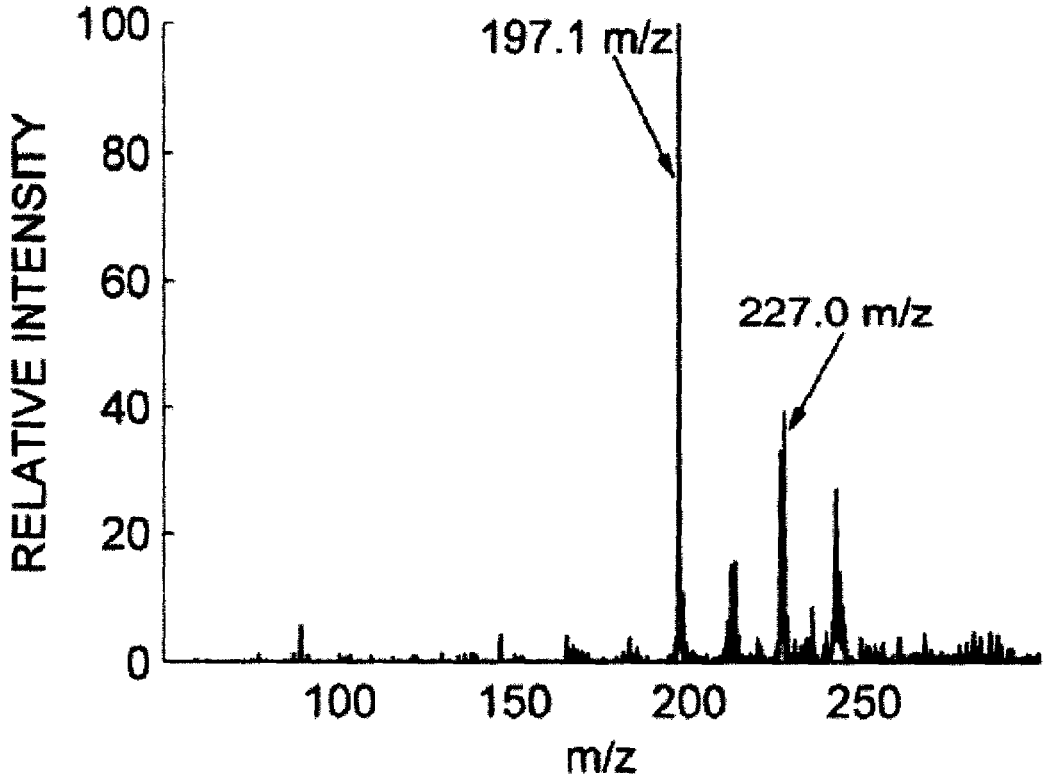
FIG. 10 is a diagram that illustrates the mass spectrum of 20 ng TNT using thermal desorption SwiFerr operation.

For explosives detection, an aliquot of TNT in acetonitrile solution was deposited into the thermal desorption cell. FIG. 10 is a mass spectrum of 20 ng TNT ionized with the miniature SwiFerr source after thermal desorption. Present in the mass spectrum are peaks for the TNT radical anion, as well as a peak for the species minus NO. This pattern is consistent with previous ambient ionization work done with TNT, in which TNT has been seen to lose NO. The production of the radical anion of TNT illustrates the production of free electrons by SwiFerr, which is not unexpected owing to the presence of plasma. This demonstrates that a new class of analytes are now detectable using SwiFerr, which is not limited to those analytes ionized by proton transfer reactions.

Limit of Detection for Organic Vapors

Figure 11A:
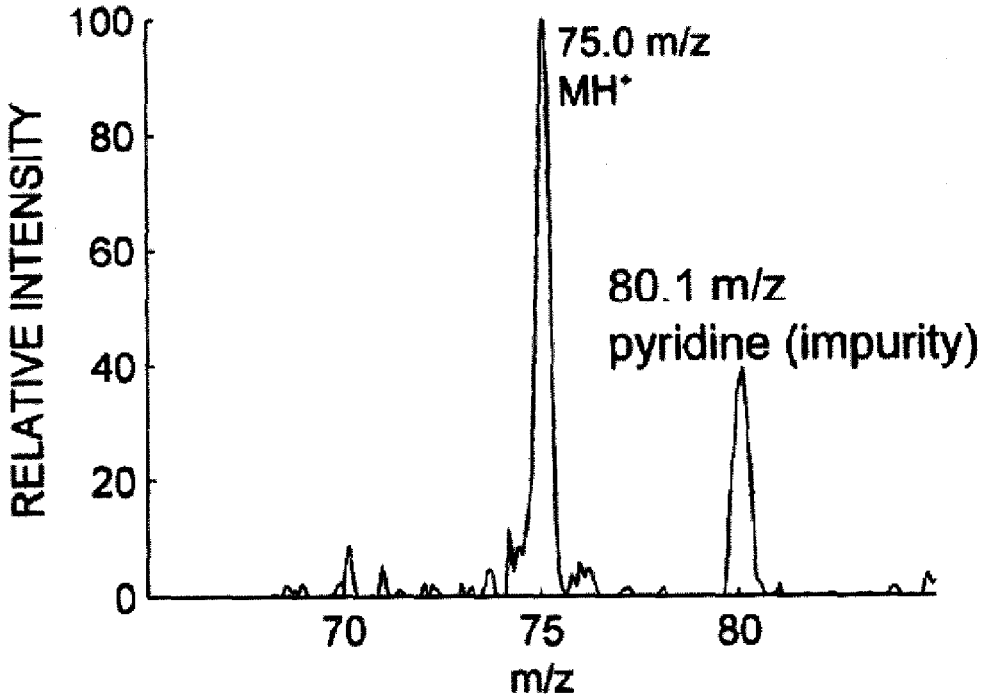
FIG. 11A is a diagram that illustrates the mass spectrum of diethyl ether at 2 ppm in which good signal-to-noise ratio is achieved with background subtraction.

Sample dilution was performed to determine the performance and detection limits for the SwiFerr ionizer. Diethyl ether was chosen as a test compound for performance evaluation. Samples of diethyl ether vapor were prepared in Tedlar sample bags and analyzed using SwiFerr. FIG. 11A shows the detection of diethyl ether at a concentration of 2 ppm in air. Detection of diethyl ether at a concentration of 2 ppm with a signal-to-noise ratio of approximately 5 indicates that the ultimate sensitivity of SwiFerr for this compound, in the current source configuration, is likely in the high part per billion (ppb) range. For some materials, it is expected that this sensitivity can be extended into the part per trillion range.

Figure 11B:
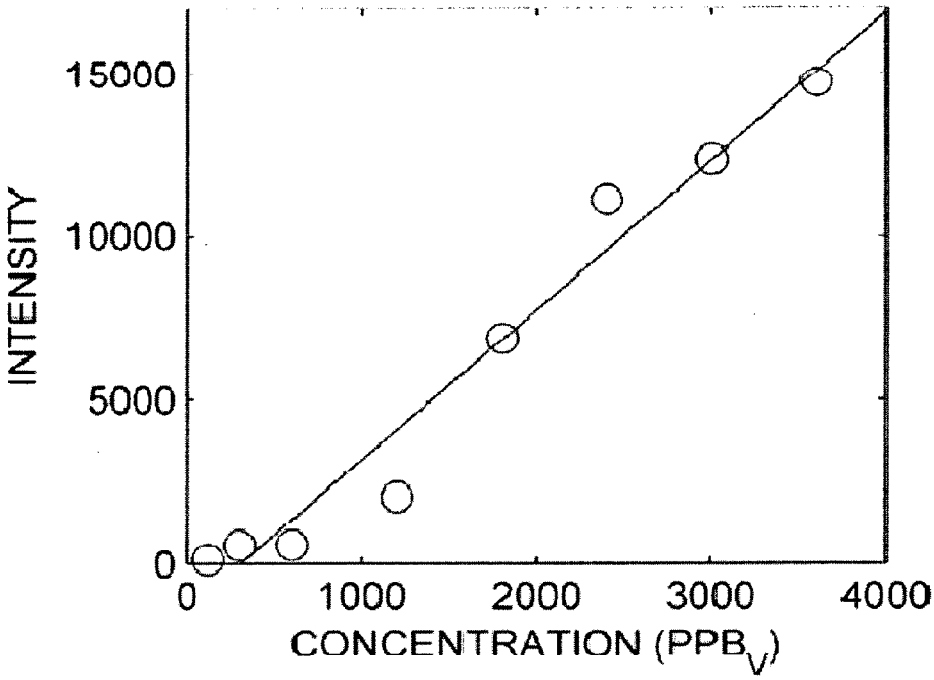
FIG. 11B is a diagram that illustrates the correlation of signal intensity with concentration.

FIG. 11B is a plot relating sample concentration from the gas diluter to signal observed in the mass spectrometer. Integrated signal for the diethyl ether peak rises in a linear fashion from approximately 100 ppb to 4 ppm. Decreased sensitivity at higher concentrations (above 4 ppm) was observed and is likely due to saturation of the source region at high analyte concentrations as well a possible scenario where hydronium ion is a limiting reagent.

$$H_3O^+ + M \rightarrow MH^+ + H_2O \qquad \text{Eqn.(3)}$$

One would like all of the reagent ions to be converted to ionized target species to enable their detection. It is important to avoid contaminants that react with $H_3O^+$ so as to yield stable protonated species that will not transfer a proton to a specifically targeted minor species. It is advantageous to keep the source as clean as possible to achieve high sensitivity.

Capacitance of Embodiment 2 Source; Power Usage

Since both SwiFerr embodiments are intended for use in devices which are field portable, attention to the power consumption in the device is appropriate. It was found that lower frequency operation of the source is preferred with respect to power consumption, and that no gain in signal was found by operating at higher frequencies. Instead, higher frequency simply excited the source capacitance more efficiently and power consumption increased without a corresponding increase in signal. Power consumption varies significantly with frequency at constant voltage as shown in FIG. 12 indicating that any resistive portion of impedance (the denominator in Equation 2) is negligible compared to capacitative effects.

$$P = V^2_{RMS} 2\pi f C \qquad \text{Eqn.(4)}$$

Figure 12:
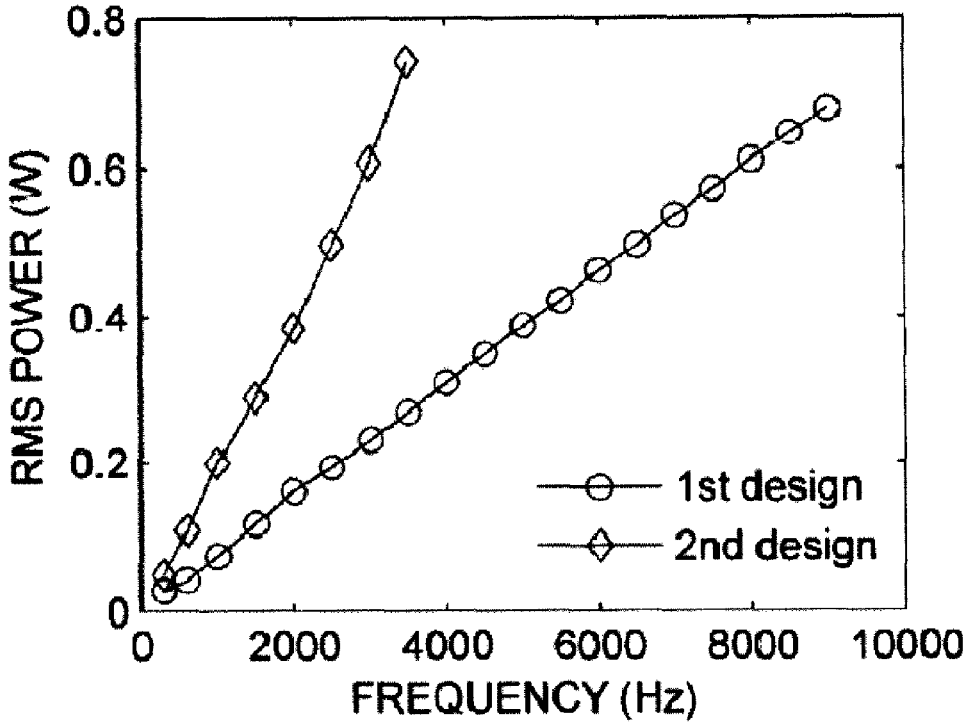
FIG. 12 is a graph that illustrates the variation of power consumed with frequency for two different SwiFerr designs.

Reducing Equation 2 to the form of Equation 4 reveals that if a plot is made of power versus frequency, as in FIG. 12 the slope of the line is the capacitance of the crystal times the constant $V^2_{RMS}2\pi f$. Voltage was held constant at 600 V p-p (212 V RMS), and the capacitance values for the original SwiFerr source and the revised embodiment are $2.7\times10^{-10}$ F and $7.5\times10^{-10}$ F, respectively. Increased capacitance in the revised source design is suspected to result from more efficient polarization switching and plasma formation when using the TEM grid as opposed to the copper mesh. The TEM grid is a finer mesh, exposing more of the crystal face to ambient atmosphere and increasing the probability of favorable interaction between atmospheric water and the plasma. The TEM grid being thinner effects better contact between the grid and crystal surface, increasing the electric fields across the domain walls at the surface as well as increasing the effective electrode area in the capacitor created by the front and rear electrode separated by the dielectric crystal.

For the first SwiFerr embodiment, a capacitance of $2.7\times10^{-10}$ F is calculated, while for the second design a capacitance of $7.5\times10^{-10}$ F is calculated. The increased capacitance in the second design is thought to originate from more efficient switching and plasma production as well as an effective increase in plate area for the capacitor created by the rear electrode, front grid electrode, and crystal dielectric material.

Application of Swiferr Technology for the Detection of Disease Markers in Human Breath by Mass Spectrometry Early detection of disease can often make the difference in whether a patient can avoid or must endure the symptoms and outcome of the disease. For chronic illnesses and for those diseases with no known cure, early diagnosis and treatment can slow down the progression and severity of the illness. Unfortunately, many of the diagnostics tests available today are too cumbersome or expensive to perform routinely on non-symptomatic patients, and doing so would be a waste of time and resources. For example, a primary care doctor could choose to send his or her patient for comprehensive blood work every time the patient comes for a routine check-up, but many doctors will not order such results until they perceive a possible disease symptom. Such testing might inconvenience and discourage patients, and might involve unnecessary costs for patients or for insurance companies. A quick and effective detection system that could be placed in doctor's offices and used to both diagnose those who show symptoms and detect hidden diseases in those who do not show symptoms would allow for an improved screening process. When someone tests positive for a disease the doctor can immediately order confirmatory diagnostic tests or schedule the patient to meet with a specialist. The present system is expected to provide sensitive detection and rapid characterization of volatile compounds that can be correlated to human diseases through breath analysis with mass spectrometry.

Analysis of volatile organic compounds at trace levels in breath requires their selective ionization in ambient air at atmospheric pressure, followed by efficient sampling of ions into a mass spectrometer for analysis. The SwiFerr technology is expected to be suitable for sensitive detection of disease markers in human breath.

In the doctor's office, the target molecules to be analyzed would originate from a patient's breath. Humans exhale a variety of volatile molecules, and these can often be analyzed to detect and quantify organic components of blood. Certain organic metabolites can diffuse passively across the pulmonary alveolar membrane and then vaporize. The concentrations of vaporized metabolites in breath are reflective of their concentrations in the blood, so analysis of the breath can be a noninvasive way to identify trace organics in blood. A number of studies have already identified specific compounds in patients with systemic disease, such as acetone for diabetes mellitus, 8-isoprostane for sleep apnea and limonene for liver disease (see Table I). Table I lists some oral/breath volatiles identified in patients with systemic disease, and is taken from Whittle, C. L.; Fakharzadeh, S.; Eades, J.; Preti, G. Human Breath Odors and Their Use in Diagnosis. *Annals of the New York Academy of Sciences* 2007, 1098, 252-66. References for this table can be found in the Whittle paper.

It is expected that some or all of the compounds listed in Table I can be rapidly detected and analyzed using SwiFerr ionization at ambient pressure and temperature.

One can expect to prepare samples of the compounds of interest at known concentrations as well as at the concentrations found in human breath and then use the SwiFerr to analyze the samples. Volunteers can be expected to be used to provide human breath samples from which one may expect to detect and identify trace organics.

TABLE I

| Pathologic condition | Compound(s) |
|---|---|
| Diabetes mellitus | Acetone, other ketones |
| | Breath methylated alkane contour (BMAC) |
| Sleep apnea | Interleukin IL-6, 8-isoprostane |
| *H. Pylori* infection | Nitrate, cyanide |
| | Carbon dioxide |
| Sickle cell disease | Carbon monoxide |
| Methionine adenosyl-transferase deficiency | Dimethylsulfide |
| Asthma | Leukotrienes |
| Breast cancer | 2-propanol, 2,3-dihydro-1-phenyl-4 (1H)-quinazoli-none, 1-phenyl-ethanone, heptanal |
| Lung carcinoma | Acetone, methylethylketone, n-propanol |
| | Aniline, o-toluidine |
| | Alkanes, mono-methylated breath alkanes, alkenes |
| Chronic obstructive pulmonary disease | Hydrogen peroxide |
| | Nitrosothiols |
| | Nitrosothiols nitric oxide |
| Cystic fibrosis | 8-isoprostane |
| | Leukotriene B(4), interleukin-8 |
| Liver disease | Hydrogen disulfide, limonene |
| Noncholestatic | Hydrogen disulfide |
| Primary biliary cirrhosis | |
| Decompensated cirrhosis of the liver (foetor hepaticus) | $C_2$-$C_5$ aliphatic acids, methylmercaptan |
| | Ethanethiol, dimethylsulfide |
| Uremia/kidney failure | Dimethylamine, trimethylamine |
| Trimethylaminuria | Trimethylaminine |

A novel ion source for ambient mass spectrometry has been developed which utilizes the plasma formed on the surface of a switched ferroelectric material in contact with a grounded grid electrode for ionization of trace neutrals at ambient pressure, with good sensitivity and very low power requirements. Both anions and cations are observed from the same source arrangement due to chemical ionization because reactive chemical ionization agents of both polarities are produced by the plasma. Basic species such as triethylamine, tripropylamine, and tributylamine as well as the pharmaceutical loperamide were detected as singly protonated cations in the mass spectra. Acidic species such as acetic acid and the pharmaceutical ibuprofen were detected as singly deprotonated anions. In the case of acetic acid, proton bound clusters of the anion were also detected. Sensitivity of the source to sample concentration was tested using a gas dilution method and detection limits for pyridine were determined to be in the high ppb range, indicating suitability for use in a range of analytical applications. Lastly, electrical characteristics and power consumption of the source were analyzed. The source consumes less than one watt of power under normal operation, which is unique for a plasma based ionization technique. Power consumption varies with frequency as a consequence of the crystal appearing as a capacitive load in the circuit. As a result, operation at lower frequencies is desired when the minimization of power consumption is a goal.

An Analytical System and its Operation

Figure 13:
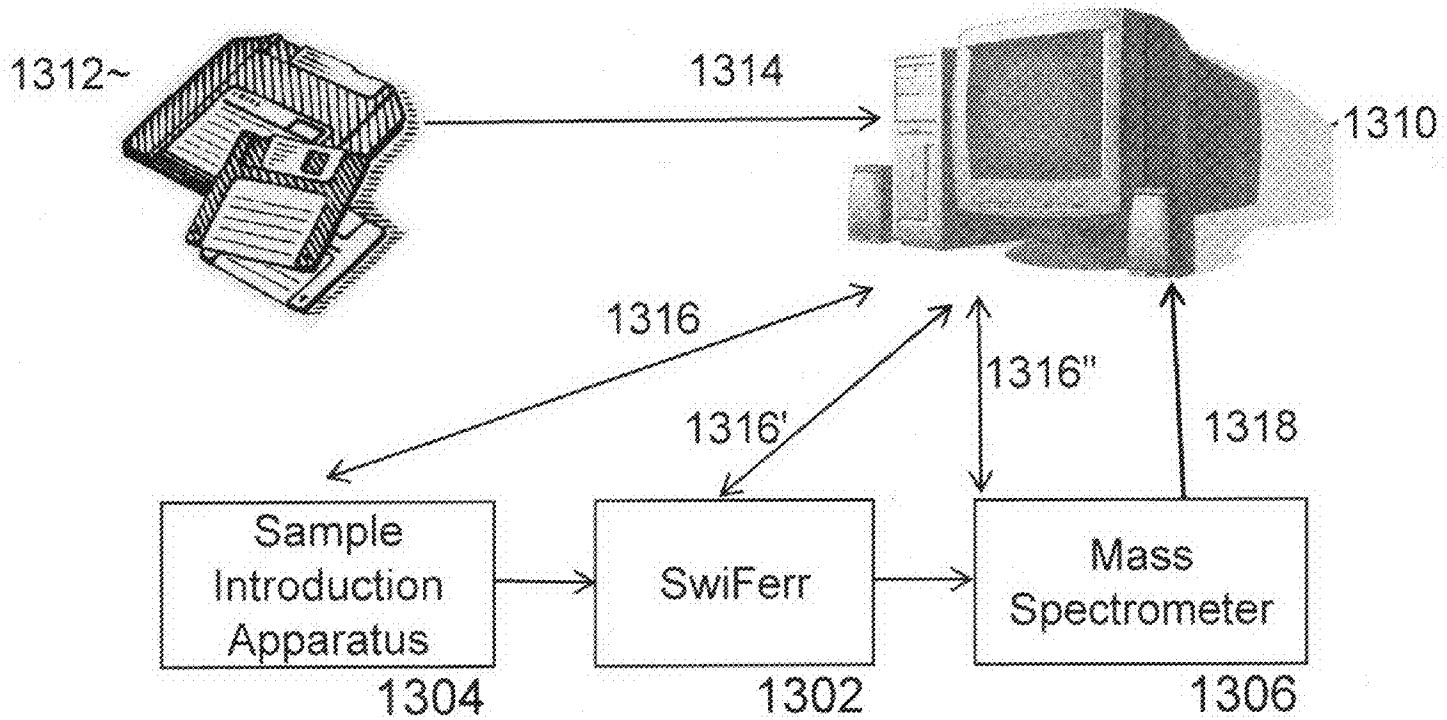
FIG. 13 is a schematic diagram that illustrates a hardware system that can be provided to implement the disclosed invention.

FIG. 13 is a schematic diagram that illustrates a hardware system that can be provided to implement the disclosed invention. As illustrated in FIG. 13, a system is expected to include a Swiferr ionization source 1302, a sample introduction apparatus 1304, a mass spectrometer 1306, and a general purpose programmable computer 1310 programmed with computer instructions in machine readable format on a machine readable medium such as a floppy disk 1312 (e.g., software). Arrow 1314 indicates that the floppy disk 1312 can be inserted into a disk drive of the computer. The computer 1310 is configured to control the operation of the Swiferr ionization source 1302, the sample introduction apparatus 1304, and the mass spectrometer 1306. Bidirectional arrows 1316, 1316', 1316" denote the control signals sent from the computer 1310 to the Swiferr ionization source 1302, the sample introduction apparatus 1304, and the mass spectrometer 1306, and the return operational signals that the computer 1310 receives so as to monitor the operation of each of the Swiferr ionization source 1302, the sample introduction apparatus 1304, and the mass spectrometer 1306. The arrows from the sample introduction apparatus 1304 to the Swiferr ionization source 1302 and from the Swiferr ionization source 1302 to the mass spectrometer 1306 indicate the flow of the sample that is being analyzed. The computer 1310 is configured to receive data from the mass spectrometer 1306. Arrow 1318 indicates the flow of data from the mass spectrometer 1306 to the computer 1310. The computer 1310 when running the software is configured to perform the requisite calculations, and to provide a computed result in any convenient form, such as a graphical display or a numerical table, and can record the result (for example on a floppy 1312), store the result for later use, transmit the result to a user or to another computational system, and/or display the result to a user (for example on the display of the computer 1310).

Under control of the general purpose programmable computer 1310, the Swiferr ionization source 1302, the sample introduction apparatus 1304, and the mass spectrometer 1306 provide data about a sample passed through the system. The data so generated is then processed using the mathematical relationships and procedures described hereinabove to determine the presence and concentration of analytes of interest In various embodiments, the sample introduction apparatus 1304 can be any of an aspirator, a thermal desorption apparatus configured to produce a volatile component of interest from a liquid or a solid specimen, a sample injection apparatus, or a human source (for example, a breath sample).

Definitions

Recording a result is understood to mean and is defined herein as writing output data to a storage element, to a machine-readable storage medium, or to a storage device. Machine-readable storage media that can be used in the invention include electronic, magnetic and/or optical storage media, such as magnetic floppy disks and hard disks; a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks); and electronic storage media, such as RAM, ROM, EPROM, Compact Flash cards, PCMCIA cards, or alternatively SD or SDIO memory; and the electronic components (e.g., floppy disk drive, DVD drive, CD/CD-R/CD-RW drive, or Compact Flash/PCMCIA/SD adapter) that accommodate and read from and/or write to the storage media. As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and machine-readable symbols such as one and two dimensional bar codes. Recording image data for later use (e.g., writing an image to memory or to digital memory) can be performed to enable the use of the recorded information as output, as data for display to a user, or as data to be made available for later use. Such digital memory elements or chips can be standalone memory devices, or can be incorporated within a device of interest. "Writing output data" or "writing an image to memory" is defined herein as including writing transformed data to registers within a microcomputer.

"Microcomputer" is defined herein as synonymous with microprocessor, microcontroller, and digital signal processor ("DSP"). It is understood that memory used by the microcomputer, including for example an imaging or image processing algorithm coded as "firmware" can reside in memory physically inside of a microcomputer chip or in memory external to the microcomputer or in a combination of internal and external memory. Similarly, analog signals can be digitized by a standalone analog to digital converter ("ADC") or one or more ADCs or multiplexed ADC channels can reside within a microcomputer package. It is also understood that field programmable array ("FPGA") chips or application specific integrated circuits ("ASIC") chips can perform microcomputer functions, either in hardware logic, software emulation of a microcomputer, or by a combination of the two. Apparatus having any of the inventive features described herein can operate entirely on one microcomputer or can include more than one microcomputer.

General purpose programmable computers useful for controlling instrumentation, recording signals and analyzing signals or data according to the present description can be any of a personal computer (PC), a microprocessor based computer, a portable computer, or other type of processing device. The general purpose programmable computer typically comprises a central processing unit, a storage or memory unit that can record and read information and programs using machine-readable storage media, a communication terminal such as a wired communication device or a wireless communication device, an output device such as a display terminal, and an input device such as a keyboard. The display terminal can be a touch screen display, in which case it can function as both a display device and an input device. Different and/or additional input devices can be present such as a pointing device, such as a mouse or a joystick, and different or additional output devices can be present such as an enunciator, for example a speaker, a second display, or a printer. The computer can run any one of a variety of operating systems, such as for example, any one of several versions of Windows, or of MacOS, or of UNIX, or of Linux. Computational results obtained in the operation of the general purpose computer can be stored for later use, and/or can be displayed to a user. At the very least, each microprocessor-based general purpose computer has registers that store the results of each computational step within the microprocessor, which results are then commonly stored in cache memory for later use.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A switched ferroelectric plasma ionizer operable at ambient pressure, comprising:

a ferroelectric material having first and second surfaces on opposite sides thereof;

a grid electrode disposed adjacent to said first surface of said ferroelectric material, said grid electrode having a connection terminal configured to be connected to a first terminal of a voltage source;

a second electrode disposed adjacent to said second surface of said ferroelectric material, said second electrode having a connection terminal configured to be connected to a second terminal of a voltage source; and a housing disposed about said ferroelectric material, said grid electrode and said second electrode, said housing having an inlet port and an outlet port, said housing configured to contain at ambient pressure a volume of gas adjacent to said first surface of said ferroelectric material.

2. The switched ferroelectric plasma ionizer operable at ambient pressure of claim 1, wherein said ferroelectric material having first and second surfaces is a single crystal.

3. The switched ferroelectric plasma ionizer operable at ambient pressure of claim 2, wherein said single crystal of said ferroelectric material is an oriented single crystal cut along a selected crystallographic direction.

4. The switched ferroelectric plasma ionizer operable at ambient pressure of claim 3, wherein said oriented single crystal cut along a selected crystallographic direction is a [001] cut single crystal of $BaTiO_3$.

5. The switched ferroelectric plasma ionizer operable at ambient pressure of claim 1, wherein said grid electrode is connected to ground potential.

6. The switched ferroelectric plasma ionizer operable at ambient pressure of claim 1, wherein said second electrode is connected to a terminal of a voltage source configured to provide an alternating voltage of sufficient magnitude to satisfy the relationship $|V/d|>E_c$ where V is an amplitude of an applied alternating voltage relative to ground, d is a thickness of said ferroelectric material between said grid electrode and said second electrode, and $E_c$ is a coercive field of said ferroelectric material.

7. The switched ferroelectric plasma ionizer operable at ambient pressure of claim 6, configured so that an application of said applied voltage of amplitude V is controlled by a programmable general purpose computer.

8. The switched ferroelectric plasma ionizer operable at ambient pressure of claim 1, wherein said inlet port of said housing is in fluid communication with a source of a material of interest to be analyzed.

9. The switched ferroelectric plasma ionizer operable at ambient pressure of claim 1, wherein said outlet port of said housing is in fluid communication with an analyzer apparatus.

10. The switched ferroelectric plasma ionizer operable at ambient pressure of claim 9, wherein said analyzer apparatus is a mass spectrometer.

11. The switched ferroelectric plasma ionizer operable at ambient pressure of claim 1, further comprising a thermal desorption apparatus configured to produce a volatile component of interest from a liquid or a solid specimen, said thermal desorption apparatus having a outlet port in fluid communication with said inlet port of said housing.

12. An ambient pressure gas analysis method, comprising the steps of:

exposing a gaseous sample of interest to a switched ferroelectric plasma ionizer operating at substantially ambient pressure, said switched ferroelectric plasma ionizer having a ferroelectric material having first and second surfaces on opposite sides of said ferroelectric material; a grid electrode disposed adjacent to said first surface of said ferroelectric material, said grid electrode having a connection terminal configured to be connected to a first terminal of a voltage source; a second electrode disposed adjacent to said second surface of said ferroelectric material, said second electrode having a connection terminal configured to be connected to a second terminal of a voltage source; and a housing disposed about said ferroelectric material, said grid electrode and said second electrode, said housing having an inlet port and an outlet port, said housing configured to contain at substantially ambient pressure said gaseous sample of interest adjacent to said first surface of said ferroelectric material;

applying a ground potential to said grid electrode;

applying an alternating voltage of sufficient magnitude to satisfy the relationship $|V/d|>E_c$ to said second electrode, where V is an amplitude of said applied alternating voltage relative to ground, d is a thickness of said ferroelectric material between said grid electrode and said second electrode, and $E_c$ is a coercive field of said ferroelectric material;

analyzing an ionic species generated from said gaseous sample of interest to obtain a result; and performing at least one of recording said result, transmitting said result to a data handling system, or to displaying said result to a user.

13. The ambient pressure gas analysis method of claim 12, wherein said ferroelectric material having first and second surfaces is a single crystal.

14. The ambient pressure gas analysis method of claim 13, wherein said single crystal of said ferroelectric material is an oriented single crystal cut along a selected crystallographic direction.

15. The ambient pressure gas analysis method of claim 12, wherein said oriented single crystal cut along a selected crystallographic direction is a [001] cut single crystal of $BaTiO_3$.

16. The ambient pressure gas analysis method of claim 12, wherein said step of applying said alternating voltage is controlled by a programmable general purpose computer.

17. The ambient pressure gas analysis method of claim 12, wherein said step of analyzing an ionic species is controlled by a programmable general purpose computer.

18. The ambient pressure gas analysis method of claim 12, wherein said step performing at least one of recording said result, transmitting said result to a data handling system, or to displaying said result to a user is performed by a programmable general purpose computer.

19. The ambient pressure gas analysis method of claim 12, wherein said step of analyzing an ionic species is performed using a mass spectrometer.

20. The ambient pressure gas analysis method of claim 12, further comprising the step of producing a volatile component of interest from a liquid or a solid specimen in a thermal desorption apparatus and supplying said volatile component of interest as said gaseous sample of interest.

21. The ambient pressure gas analysis method of claim 12, wherein said step of exposing a gaseous sample of interest comprises exposing a gaseous sample derived by passing a carrier gas over a solid sample to produce the sample of interest.

22. The ambient pressure gas analysis method of claim 12, wherein said step of exposing a gaseous sample of interest comprises exposing a gaseous sample that includes fine particles entrained therein as the sample of interest.

23. The ambient pressure gas analysis method of claim 12, wherein said step of exposing a gaseous sample of interest comprises exposing a gaseous sample derived from a human breath as the sample of interest.

* * * * *